US005375937A

United States Patent [19]

Oh

[11] Patent Number: 5,375,937

[45] Date of Patent: Dec. 27, 1994

[54] ALBUM

[76] Inventor: Byung-Kwon Oh, 332-1, Yolmi-Ri, Shilchon-Myon, Kyungki-Do, Rep. of Korea

[21] Appl. No.: 39,622

[22] Filed: Mar. 30, 1993

[30] Foreign Application Priority Data

Apr. 1, 1992 [KR] Rep. of Korea ..... 92-5310

[51] Int. Cl.[5] ..... B42F 13/00

[52] U.S. Cl. ..... 402/73; 402/70; 281/36; 281/37

[58] Field of Search ..... 402/70, 73, 78, 77, 402/80, 502; 281/36, 37, 29

[56] References Cited

U.S. PATENT DOCUMENTS 3,298,714 1/1967 Celmen ..... 402/80
4,575,273 3/1986 Gerriet ..... 402/73 X
5,209,593 5/1993 Ros ..... 402/73 X

*Primary Examiner*—Willmon Fridie
*Attorney, Agent, or Firm*—Lerner, David, Littenberg, Krumholz & Mentlik

[57] ABSTRACT

An album includes first and second shells hingedly connected together and defining a storage cavity therebetween. A plurality of leaves for mounting pictures are connected to the album and held in the storage cavity between the shells. Retaining members are provided on each of the shells so that, in the open position of the album, a portion of the leaves will be held against one of the shells and another portion of the leaves will be held against the other one of the shells. A cover over the exterior of the shells provides the album with a soft, cushioned feel. The album stores pictures securely for travel, yet may be used as a picture frame when opened and set on end.

6 Claims, 3 Drawing Sheets

ALBUM

FIELD OF THE INVENTION

The present invention relates generally to an album, and more particularly to an album in which pictures are easily pasted or inserted and securely held without damage for long periods of time. The album is usable as a picture frame when opened and set on end.

BACKGROUND OF THE INVENTION

In conventional albums, the cover is typically made from a thick paper material, the edges of which are easily damaged by external mechanical shock. In addition, these albums normally are uneven in thickness such that it is difficult to stack several albums on top of one another.

One proposal to overcome these drawbacks to conventional albums has been to provide a cased album in which the pictures are pasted in a case formed from a synthetic material. However, such cased albums are easily broken when dropped or subjected to other mechanical shock. Therefore, these albums are difficult to manage and are impractical to use. In addition, since the outer surface of the case is made from a synthetic material, it has an unpleasant feel when touched.

SUMMARY OF THE INVENTION

Accordingly, an object of the present invention is to provide an album which is capable of storing pictures without damage over long periods of time, yet which provides a soft, comfortable feel to the touch. A further object is to provide an album which, in an open state, can be used as a picture frame.

In accordance with the present invention, the above objects can be achieved by constructing an album from upper and lower shells each formed from a rigid synthetic material. The shells are hingedly connected to one another for movement between an open position and a closed position, the shells in the closed position defining a storage cavity. A plurality of leaves for holding objects are connected between the shells so that the leaves reside in the storage cavity when the shells are in the closed position. Retaining means releasably retain one portion of the plurality of leaves adjacent the first shell and another portion of the plurality of leaves adjacent the second shell when the shells are in the open position.

In preferred embodiments, the album further includes cushioned cover means for covering an exterior surface of the first and second shells. The cushioned cover means preferably consists of a first layer of a first paper material, a second layer of a second paper material overlying the first layer and a third layer of a cushioning material interposed between the first and second layers. The first, second and third layers define a stacked structure, and an outer layer may cover at least one side of this stacked structure. In particularly preferred embodiments, the first paper material consists of a pasteboard, the second paper material consists of an oil paper, and the cushioning material consists of a sponge material.

In another preferred embodiment of the present invention, the retaining means includes a first clip connected to the first shell and rotatable between a retaining position for retaining one portion of the plurality of leaves adjacent the first shell and a release position for releasing the one portion of the plurality of leaves for movement with respect to the first shell, and a second clip connected to the second shell and rotatable between a retaining position for retaining another portion of the plurality of leaves adjacent the second shell and a release position for releasing the another portion of the plurality of leaves for movement with respect to the second shell.

Preferred albums in accordance with the present invention are capable of safely storing pictures over long periods of time and protecting the pictures from damage as a result of mechanical shock. These albums provide further advantages in that they present a soft, comfortable feel to the touch and may be used as a picture frame when opened and set on end.

BRIEF DESCRIPTION OF THE DRAWINGS

The above and other objects, features and advantages of the present invention will be apparent from the following detailed description, in which reference is made to the accompanying drawings in which.

DETAILED DESCRIPTION OF THE PREFERRED EMBODIMENTS

Now, preferred embodiments of the present invention will be described in detail.

Figure 1:
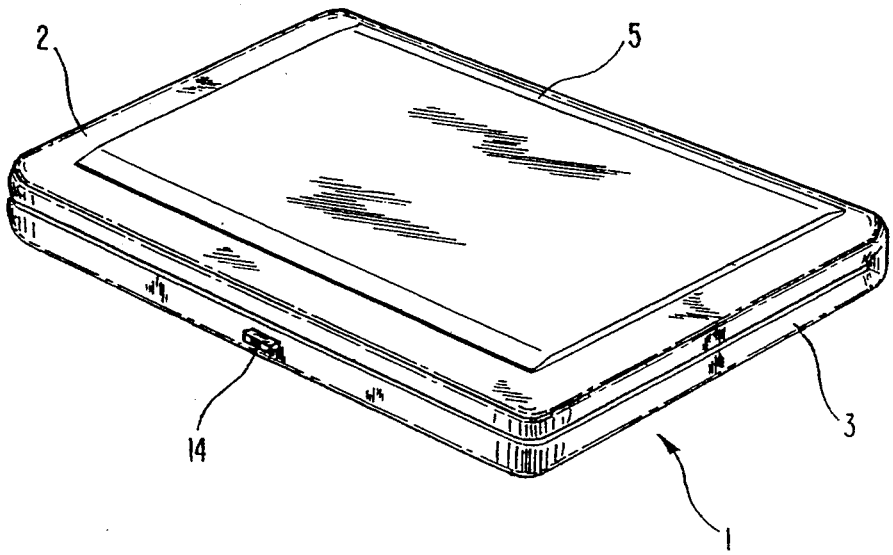
FIG. 1 is a perspective view of an album in accordance with the present invention in the closed state.
Figure 2:
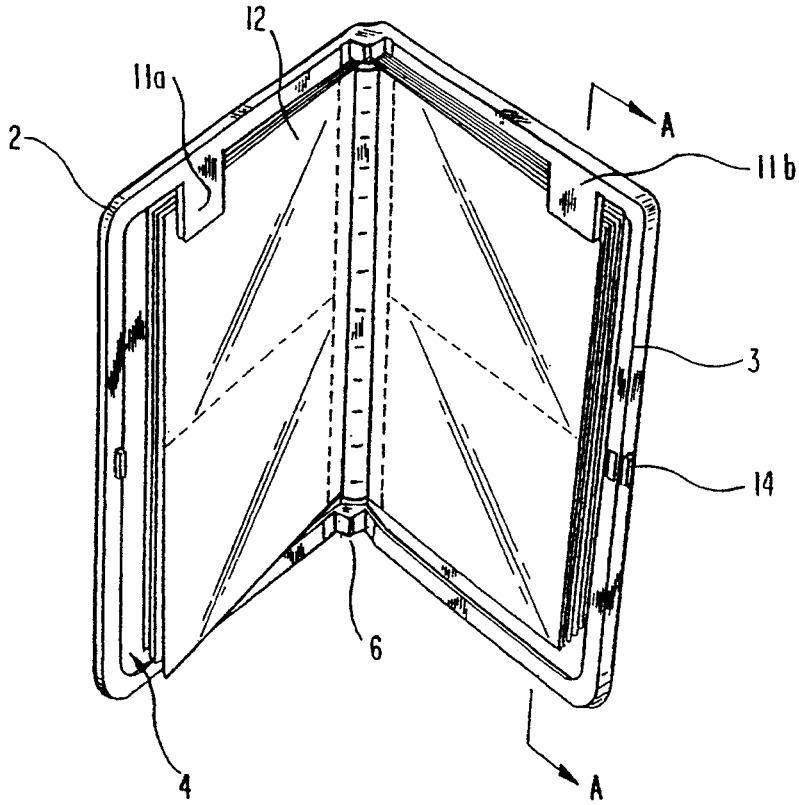
FIG. 2 is a perspective view of the album of FIG. 1 in an open state.
Figure 3:
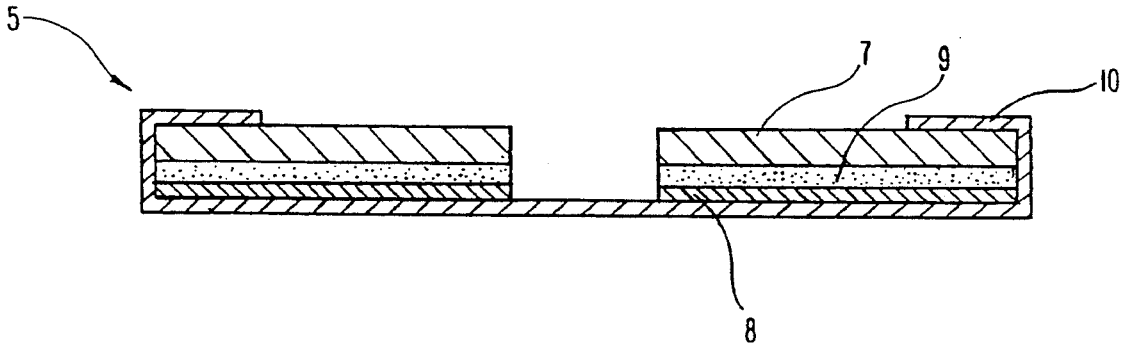
FIG. 3 is a cross-sectional view showing the album cover construction in accordance with the present invention.

FIG. 1 is a perspective view showing one embodiment of an album in accordance with the present invention in a closed state, and FIG. 2 is a perspective view showing the album in an open state. In the drawings, reference numeral 1 denotes an album body consisting of an upper shell 2 and a lower shell 3 hingedly connected together. Shells 2 and 3 are produced from a rigid synthetic resin and include a lip which extends along three edges on the inner faces of the shells to define a space 4 between the shells when the shells are in the closed state. Two projections 6 are formed at the upper and lower sides of a foldable center between the upper shell 2 and lower shell 3, and are inclined at both sides, respectively.

A cover 5 is adhered to the outer surfaces of shells 2 and 3. The cover 5 includes a pasteboard 7 made from a paper material having a proper thickness. A layer 8 made from a paper material, such as an oil paper or manila paper, is stacked on the pasteboard 7, excluding the center thereof. In addition, a cushion material layer 9 is assembled between the pasteboard 7 and the paper layer 8. An outer skin 10 is adhered to the outer surface of the stacked structure. Preferably, the cushion material layer 9 is formed from a resilient material such as sponge. The presence of cushion material layer 9 assures that cover 5 has an excellent feel to the touch. A latch 14 positioned on the edges of shells 2 and 3 opposite their hinged connection holds the shells in the closed state.

Figure 4:
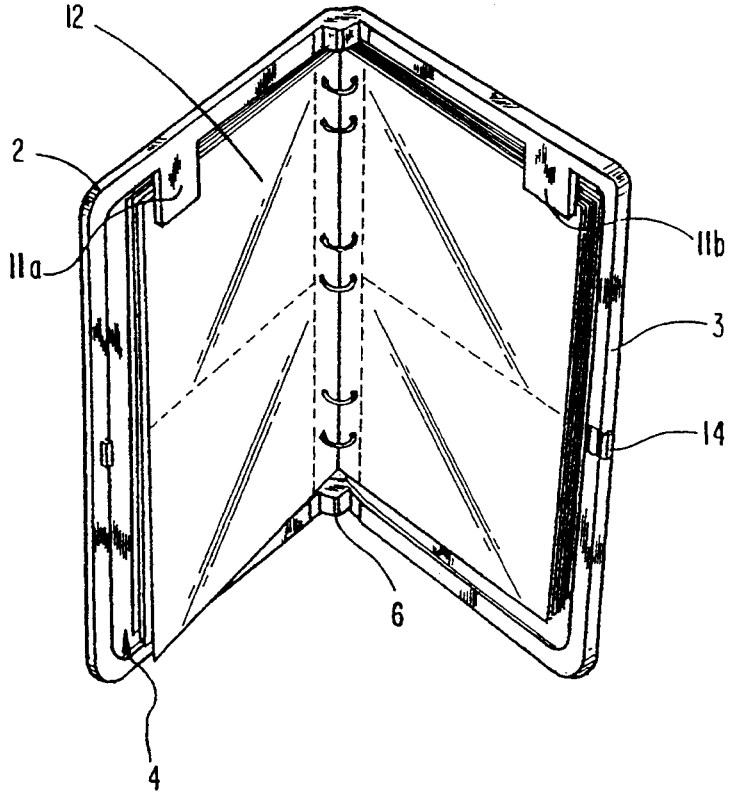
FIG. 4 is a perspective view of an alternate embodiment of an album in accordance with the present invention.
Figure 6:
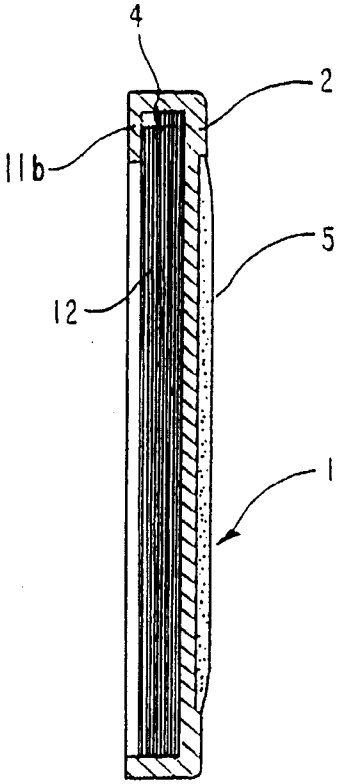
FIG. 6 is a cross-sectional view taken along line A—A in FIG. 2.

A plurality of leaves 12 for holding pictures are arranged in the space 4 defined between upper shell 2 and lower shell 3. Stoppers 11*a* and 11*b* are formed at the upper inside edges of shell 2 and shell 3 and extend downwardly over an edge of leaves 12 to hold the leaves against shells 2 and 3 and thus assure the correct posture of the leaves when the album is in an open state, and particularly when an open album is set on end. The leaves may be fixedly assembled to the album by heat-fusing one edge of each leaf to a central portion of the space 4, as shown in FIG. 2, or may be removably bound to the album by a conventional ring binder, as shown in FIG. 4.

Figure 5:
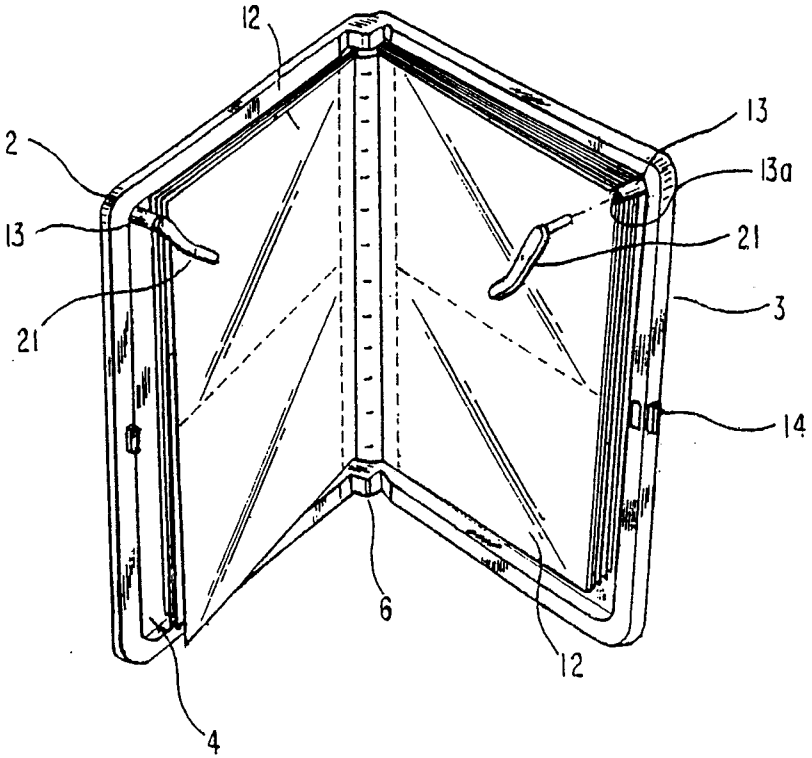
FIG. 5 is a partially disassembled perspective view of another embodiment of the album in accordance with the present invention.

Rather than stoppers 11*a* and 11*b*, the upper inside edges of shell 2 and shell 3 may be provided with projections 13, each including an insertion hole 13*a* as shown in FIG. 5. In this construction, clips 21 may be rotatably inserted in the respective holes 13*a* so that, when the clips are positioned over an edge of the leaves 12, the leaves will be held in place against the respective shells 2, 3 when the album is opened and stood on end. The leaves may be freed for turning by rotating the clips 21 in either direction so that they no longer overlap an edge of the leaves. Stoppers 11*a* and 11*b* and clips 21 may be arranged on any edge of shells 2 and 3, respectively, so long as they are capable of overlapping an edge of leaves 12 to prevent the leaves from turning over when the album is opened and set on end.

In the album constructed as set forth above, pictures are pasted on or inserted into the leaves 12. When the upper shell 2 and lower shell 3 are closed, the leaves and the pictures thereon are held in space 4. The album body 1 is sufficiently rigid that, in this closed state, it protects the pictures within from external mechanical shock. Further protection is provided by cover 5. In that regard, the cushion material layer 9 of cover 5 serves a dual purpose. It absorbs some of the mechanical shock so as to protect the album body 1 and the pictures on leaves 12 from damage, and it provides a soft comfortable feel when touched. Moreover, not only will the albums of the present invention sit flatly on a desk, but the albums provide the further advantage of being able to be safely stacked on top of one another.

After the latch 14 on the album body 1 has been released and the upper shell 2 and lower shell 3 have been opened, the album can be set on end for use as a picture frame. In this position, the stoppers 11*a* and 11*b* or clips 21 hold the leaves 12 in place against the respective shells so that they do not turn over, and so that one or more pictures as desired can be displayed. It will therefore be appreciated that the album of the present invention can produce a decorative affect and enables a family picture or the like to be taken safely during travel.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as set forth in the appended claims.

I claim:

1. An album, comprising first and second rigid shells hingedly connected to one another for movement between a closed position and an open position, each of said shells having a recess defining an open face, said open faces confronting one another in said closed position of said shells to cooperatively define a storage cavity, a plurality of leaves for holding objects, means for connecting said plurality of leaves to said shells so that said leaves reside between said shells and in said storage cavity when said shells are in said closed position and so that said leaves are movable between a position adjacent said first shell and a position adjacent said second shell when said shells are in said open position, and retaining means for releasably retaining one portion of said plurality of leaves adjacent said first shell and for releasably retaining another portion of said plurality of leaves adjacent said second shell when said shells are in said open position.

2. The album as claimed in claim 1, further comprising cushioned cover means for covering an exterior surface of said first and second shells.

3. The album as claimed in claim 2, wherein said cushioned cover means comprises a first layer of a first paper material, a second layer of a second paper material overlying said first layer and a third layer of a cushioning material interposed between said first and second layers, said first, second and third layers defining a stacked structure, and an outer layer covering at least one side of said stacked structure.

4. The album as claimed in claim 3, wherein said first paper material comprises a pasteboard and said second paper material comprises an oil paper.

5. The album as claimed in claim 4, wherein said cushioning material comprises a sponge material.

6. The album as claimed in claim 1, wherein said retaining means include a first clip connected to said first shell and rotatable between a retaining position for retaining said one portion of said plurality of leaves adjacent said first shell and a release position for releasing said one portion of said plurality of leaves for movement with respect to said first shell, and a second clip connected to said second shell and rotatable between a retaining position for retaining said another portion of said plurality of leaves adjacent said second shell and a release position for releasing said another portion of said plurality of leaves for movement with respect to said second shell.

* * * * *